US009126726B2

(12) United States Patent
Edie et al.

(10) Patent No.: US 9,126,726 B2
(45) Date of Patent: Sep. 8, 2015

(54) CLOSURE WITH APPLICATION GUIDE

(71) Applicant: Closure Systems International, Inc., Indianapolis, IN (US)

(72) Inventors: John Edie, Linden, IN (US); Daniel Elliott, Brownsburg, IN (US); Erin Green, Avon, IN (US)

(73) Assignee: Closure Systems International Inc., Indianapolis, IN (US)

( * ) Notice: Subject to any disclaimer, the term of this patent is extended or adjusted under 35 U.S.C. 154(b) by 0 days.

(21) Appl. No.: 13/906,525

(22) Filed: May 31, 2013

(65) Prior Publication Data

US 2013/0319968 A1 Dec. 5, 2013

Related U.S. Application Data

(60) Provisional application No. 61/653,900, filed on May 31, 2012.

(51) Int. Cl.
*B65D 41/38* (2006.01)
*B65D 41/04* (2006.01)

(52) U.S. Cl.
CPC ..... *B65D 41/38* (2013.01); *B65D 41/04* (2013.01); *B65D 2251/04* (2013.01)

(58) Field of Classification Search
CPC ..... B65D 41/38; B65D 41/04; B65D 2251/04
USPC ..... 220/252, 214, 218, 243, 281, 329, 356, 220/357, 44, 250; 215/252, 214, 218, 243, 215/281, 329, 356, 357, 44, 250
See application file for complete search history.

(56) References Cited

U.S. PATENT DOCUMENTS

| | | | | |
|---|---|---|---|---|
| 2,092,547 | A | 9/1937 | Allenbaugh | |
| 3,435,978 | A | 4/1969 | Wittwer | |
| 4,497,765 | A * | 2/1985 | Wilde et al. | 264/268 |
| 5,950,850 | A * | 9/1999 | Takamatsu et al. | 215/252 |
| 7,942,287 | B2 | 5/2011 | King | |
| 8,528,759 | B2 * | 9/2013 | Pucci | 215/253 |
| 2005/0056613 | A1 * | 3/2005 | King | 215/330 |
| 2005/0082249 | A1 * | 4/2005 | King | 215/329 |

OTHER PUBLICATIONS

International Search Report and Written Opinion for corresponding PCT Application No. PCT/US2013/043528 mailed Oct. 31, 2013.

* cited by examiner

*Primary Examiner* — Robert J Hicks
*Assistant Examiner* — Kareen Rush
(74) *Attorney, Agent, or Firm* — Wood, Phillips, Katz, Clark & Mortimer

(57) ABSTRACT

A plastic closure includes a top wall portion, and an annular depending skirt portion having at least one internal thread formation. In order to facilitate high-speed closure application to an associated container, the closure includes an application guide feature positioned in circumferentially spaced relationship to a thread start of the internal thread formation of the closure. The application guide feature is configured to engage the lower surface of an external thread formation of the associated container, whereby cocking, tilting, and other misalignment of the closure is avoided as it is applied to the container with high-speed application equipment.

10 Claims, 3 Drawing Sheets

CLOSURE WITH APPLICATION GUIDE

TECHNICAL FIELD

The present invention relates generally to threaded plastic closures for use on bottles and like containers, and more particularly to a container closure, and package, wherein the closure includes an application guide feature to facilitate proper application of closures to containers with high-speed capping equipment.

BACKGROUND OF THE INVENTION

Threaded plastic closures have found widespread acceptance in the marketplace for use on bottles and like containers, including use for packaging of carbonated and non-carbonated beverages. Closures of this nature are formed from suitable polymeric materials by compression or injection molding, and can be configured to provide a tamper-evident or tamper-indicating function attendant to partial or complete removal from an associated container. A tamper-evident package includes a tamper-evident closure configured for cooperation with the associated container to provide the desired tamper-evidence.

Cost-effective use of tamper-evident closures and packaging is facilitated by the use of high-speed bottling and capping equipment, which is configured to effect high-speed application of closures to respective containers. As will be appreciated, cost-effective use is promoted by avoiding any misapplication of closures to containers as they are applied at high-speed.

Misapplication of closures can occur when a closure becomes "cocked" or otherwised misaligned with the container as the closure is rotatably applied and threaded onto the external threads of the container neck. Experience has shown that features of the tamper-evident portion of the closure can sometimes result in misapplication, such as can occur if a projection or like tamper-evident feature on the closure pilfer band engages the container threads, acting to pull the closure partially out of the application chuck, resulting in cocking of the closure. In some instances, the application equipment itself can create application defects, such as can occur if a bottle is slightly offset from the associated closure, or is slightly angled with respect to the closure.

The present invention is directed to a tamper-evident closure, and tamper-evident closure and container package, which facilitates high-speed application of closures to containers while avoiding undesirable misalignment, cocking, and other misapplication defects.

SUMMARY OF THE INVENTION

A package embodying the principles of the present invention includes a plastic closure, and a container having a neck portion defining one or more external thread formations. The closure is configured for threaded application to the container for closing the contents thereof. The package is suitable for use with carbonated and non-carbonated beverages, as well as other products.

The closure of the present invention includes a top wall portion, and an annular skirt portion depending from the top-wall portion. The closure may include a tamper-evident pilfer band at least partially detachably connected to, and depending from, the skirt portion of the closure.

The skirt portion includes one or more internal thread formations for respective engagement with the one or more external thread formations of the associated container. Each of the internal thread formations is defined by a respective helic, with each thread formation having a thread start opposite the top wall portion of the closure.

In accordance with the present invention, the skirt portion of the closure further includes at least one application guide element positioned on the inside surface of the skirt portion, above the associated tamper-evident pilfer band of the closure. Notably, the application guide element preferably is configured as a thread section and has a helical configuration, and is configured to engage the external thread formation of the container upon initial contact of the closure with a container. It is contemplated that the application guide element will essentially "hook" or slide under the container thread formation, and act as a resistive member to hold the closure straight on the finish of the container neck portion and prevent closure tilting or cocking.

To this end, the application guide element is preferably vertically offset from each helix defined by the one or more internal thread formations of the closure, since positioning the guide element on the same helix as one of the closure thread formations is believed to detract from product performance. The application guide element is preferably circumferentially displaced from each thread start of the closure thread formations. The application guide element is thus engageable with one or more of the external thread formations of the neck portion of the container to facilitate threaded application of the closure to the container. High-speed application, without cocking, tilting, or other misapplication of the closure, is facilitated, with the guide element desirably acting to "balance" application of the closure to the container.

The specific configuration of the application guide element can be varied depending upon the specific closure configuration. In a presently preferred embodiment, the guide element extends circumferentially of the closure on the inside surface of the skirt portion, with the guide element extending less than 180° about the circumference of the closure. When the neck portion of the associated container defines a single, external thread formation, and the skirt portion of the closure defines a single, internal thread formation, the application guide element is preferably centered at a point circumferentially spaced about 180° from the thread start of the single, internal thread formation, that is, the guide element is diametrically opposed to the thread start.

In contrast, when the neck portion of the container defines plural external thread formations, and the skirt portion of the closure defines plural internal thread formations, the skirt portion of the closure can include plural ones of the application guide elements. In this configuration, each application guide element is centered at a point circumferentially spaced about 90° from the thread start of a respective one of the plural internal thread formations. It is contemplated that the application guide element of the closure is not provided on the same helix as the one or more internal thread formations of the closure. It is presently preferred that the guide element have a profile that is smaller than the profile of the internal thread formation of the closure, with the guide element thus being sufficiently small to promote engagement or "hooking" with the container thread formation, while being large enough to make it difficult to unhook the guide element, thus ensuring that the guide element provides the desired alignment function with the associated container.

The thickness of the one or more application guide elements will have a relationship to the amount of angle covered by the one or more guide elements. Increasing the thickness of the guide element will ordinarily decrease the amount of angle that it can cover or engage the container, without inhibiting the ability to engage or "hook" the container thread formation.

It is contemplated that closure diameter will have an effect on the potential size of the application guide element, with regard to both the thickness of the guide element, and its circumferential extent. The degree to which the closure can tilt will be affected by the height of the closure, the diameter of the closure, and the relationship between these two dimensions.

A method of making a package, including a closure having at least one application guide element, is also disclosed.

Other features and advantages will become readily apparent from the following detailed description, the accompanying drawings, and the appended claims.

DETAILED DESCRIPTION

Figure 1:
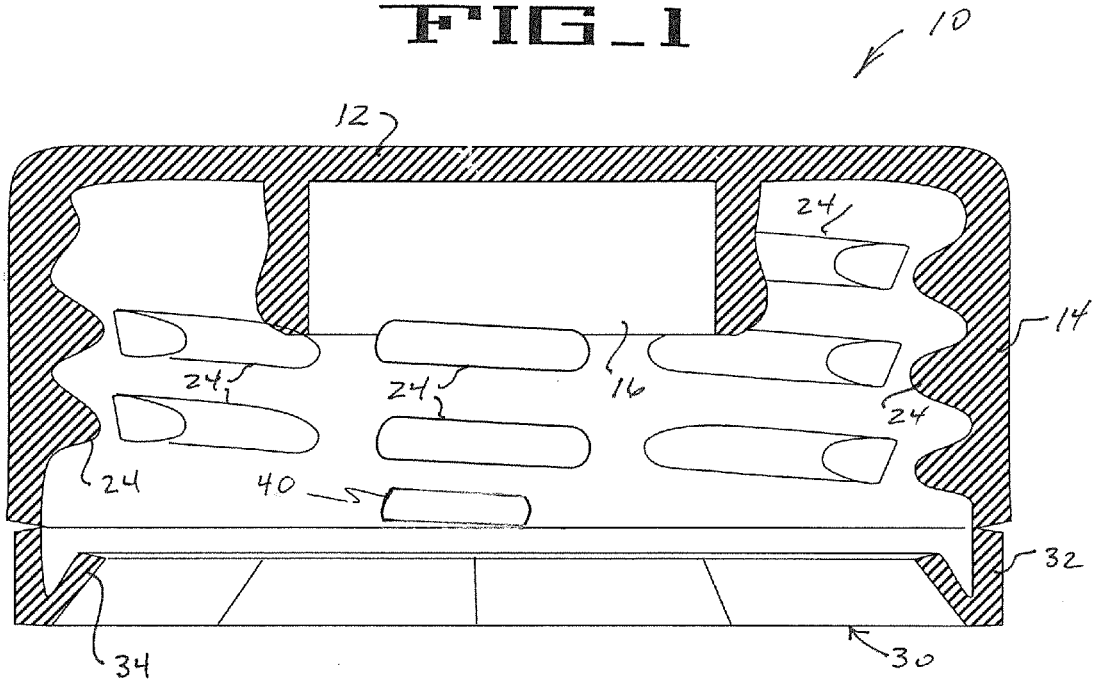
FIG. 1 is a cross-sectional, diagrammatic view of a closure embodying the principles of the present invention.

While the present invention is susceptible of embodiment in various forms, there is shown in the drawings and will hereinafter be described presently preferred embodiments, with the understanding that the present disclosure is to be considered as an exemplification of the invention, and is not intended to limit the invention to the specific embodiments illustrated.

Figure 2:
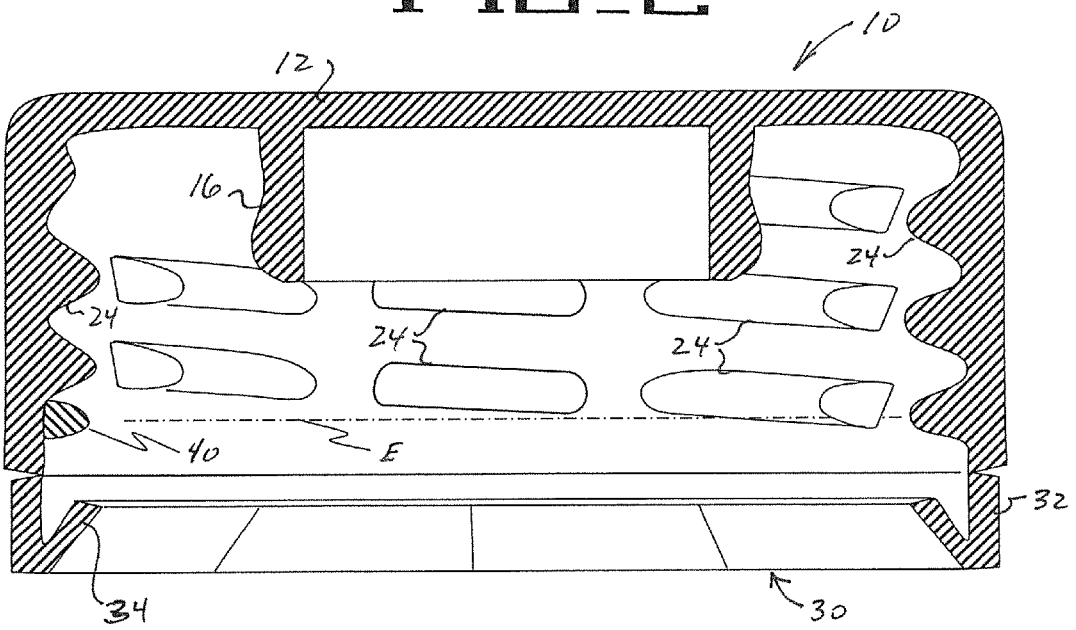
FIG. 2 is a further cross-sectional, diagrammatic view of the closure shown in FIG. 1.

With reference to the drawings, FIGS. 1 and 2 illustrate a plastic closure 10 embodying the principles of the present invention. Plastic closure 10 can be efficiently molded from polymeric materials, such as polypropylene, polyethylene, copolymers, and the like, as are known in the art. Efficient formation can be effected by injection molding or compression molding.

In the illustrated embodiment, closure 10 includes a top wall portion 12, and an annular skirt portion 14 depending from the top wall portion 12. In the illustrated embodiment, the closure 10 is a so-called "linerless" closure, in that the closure does not include a separate sealing liner element positioned at the inside surface of the top wall portion 12. Rather, closure 10 includes an intergrally formed plug seal element 16 depending from the inside surface of the top wall portion 12. The plug seal element 16 is dimensioned and configured for cooperative sealing engagement with a generally inwardly facing surface of a neck portion of an associated container 20 of the present tamper-evident package.

Closure 10 is configured for threaded fitment to the associated container 20 to form the present tamper-evident package. To this end, the container 20 includes at least one external thread formation 22, while the closure 10 includes at least one meeting, internal thread formation on the inside surface of the skirt portion 14. In the illustrated embodiment, the closure 10 includes plural ones of the internal thread formations, with each thread formation comprising a plurality of thread segments 24 configured for respective cooperative engagement with the external thread formations 22 of the container 20. Use of discontinuous internal thread formations comprising thread segments 24 is preferred for those applications wherein the closure is fitted to an associated container having carbonated or otherwise pressurized contents, since the segmented configuration of the internal thread formations facilitates venting of gas from within the package attendant to removal of the closure, and unsealing of the seal element from the container. Each of the internal thread formations formed from the thread segments 24 defines a respective helix, with the plural internal thread formations in the illustrated embodiment thus respectively defining plural helixes.

In accordance with the illustrated embodiment, the closure 10 is configured for tamper-indication, that is, configured to provide readily visually discernible evidence that the closure has been either partially or completed removed from the associated container 20. To this end, the closure 10 includes a pilfer band 30 depending from, and at least partially detachably connected to, skirt portion 14. In the illustrated embodiment, the pilfer band 30 comprises an annular band portion 32 at least partially detachably connected to the lower edge of skirt portion 14, and an interference flange 34 extending inwardly of and continuously about the circumference of annular band portion 32. The interference portion 34 is configured for cooperative engagement with a suitable annular locking ring or like element of the container 20, whereby upon opening movement of the closure with respect to the container, the annular band portion 32 of the pilfer band 30 is at least partially or completely detached from the lower edge of skirt portion 14.

In accordance with the present invention, closure 10 includes at least one application guide element 40 positioned on the inside surface of skirt portion 14 of the closure. The specific configuration of the application guide element can be varied while keeping with the principles disclosed herein. However, it will be appreciated that the application guide element is a projection on the inside surface of the skirt portion intended to engage the external thread formation 22 of container 20 as the closure is applied to the container, such as by high-speed application equipment. During application in this fashion, it is desirable to avoid any "cocking", tilting, or other misalignment of the closure 10 with respect to the container, in order to avoid misapplication of the closure to the container which can undesirably result in a defective package.

To this end, the application guide element is positioned in circumferentially spaced relationship to a thread start of each of the internal thread formations of the closure 10. The thread start is that portion of each internal thread formation positioned most closely to the open end of the closure (opposite top wall portion 12) with the thread start of each internal thread formation be that portion of the thread formation which ordinarily first comes in contact and engagement with the lower surface of the respective external thread formation 22 of the container 20.

Development of the present invention has shown that if closure 10 includes a single internal thread formation, it is particularly preferred to position the application guide element 40 in generally diametrically opposed relationship to thread start of the internal thread formation. Thus, when the container 20 includes a single external thread formation 22, and the closure 10 includes a single internal thread formation, it is preferred that the closure include a single application guide element 40 positioned in diametrically opposed relationship to the thread start of the single internal thread formation, that is, positioned such that the application guide element is centered at a point circumferentially spaced about 180° from the thread start of the single internal thread formation.

In contrast, where the container 20 includes a pair of external thread formations, and the closure includes a pair of internal thread formations, each application guide element is preferably centered at a point circumferentially spaced about 90° from the thread start of a respective one of the pair of internal thread formations. Thus, generally speaking, it is presently preferred that the application guide element be circumferentially spaced about "C" degrees from the thread start of a respective one of the one or more internal thread formations (counterclockwise from the thread start, looking into the open end of the closure), where "C" equals 180/N, where N equals the number of the internal thread formations defined by the closure.

The circumferential extent of the application guide element can be varied depending upon the specific application, but ordinarily extends no more than about 180° about the circumference of the closure, and more preferably, no more than about 30° about the circumference of the closure. It is preferred that the application guide element had a profile less than the profile of the one or more internal thread formations of the closure 20. In particular, it is preferred that the application guide element has a radial dimension less than the radial dimension of the one or more internal thread formations.

It is presently preferred that the application guide element be positioned on the inside surface of the skirt portion of the closure 10 in vertically offset relationship with the helix defined by the internal thread formation. This relationship is illustrated in FIG. 2, wherein dashed line E indicates the height of thread engagement, generally vertically offset beneath of the helix defined by the respective internal thread formation. It will be noted that application guide element 40 is positioned generally at this height of thread engagement. While the specific shape of the guide element 40 can be varied while keeping with the principles of the present invention, it is presently preferred that the guide element be configured as a thread section having a helical configuration, corresponding in orientation and pitch to the internal thread formations 22.

Figure 3:
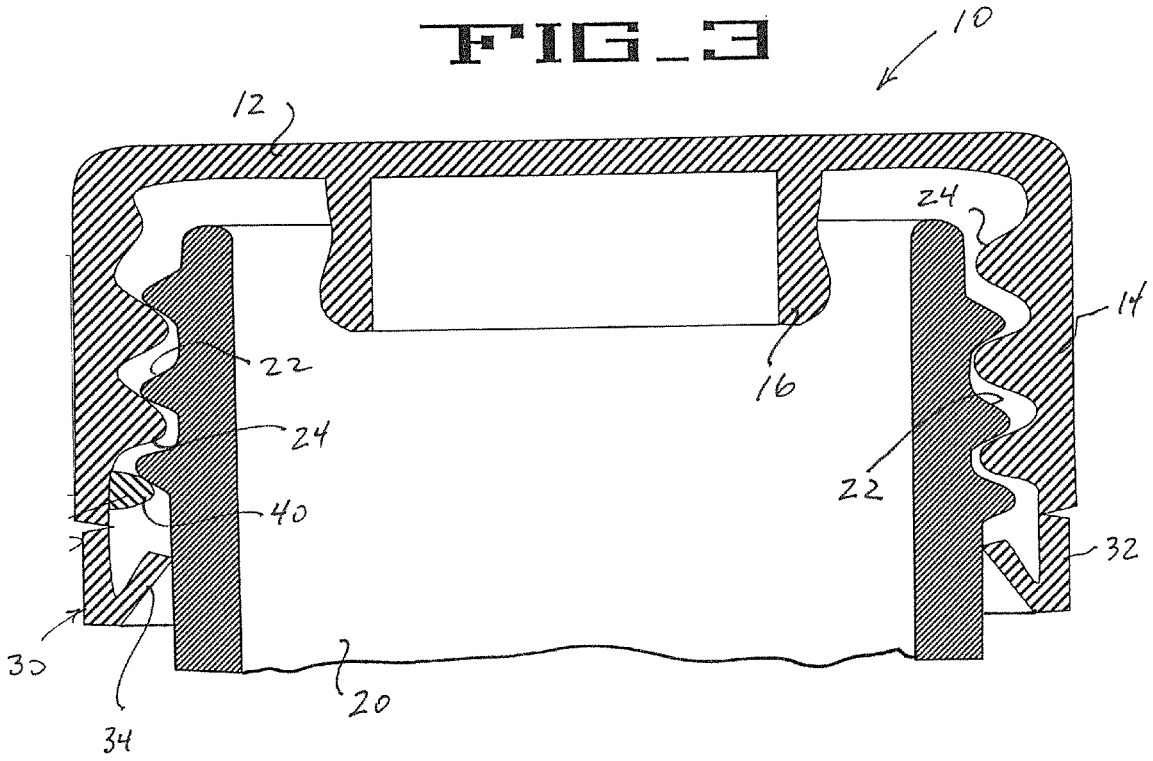
FIG. 3 is a diagrammatic view illustrating the closure of FIGS. 1 and 2 fitted to an associated container.
Figure 4:
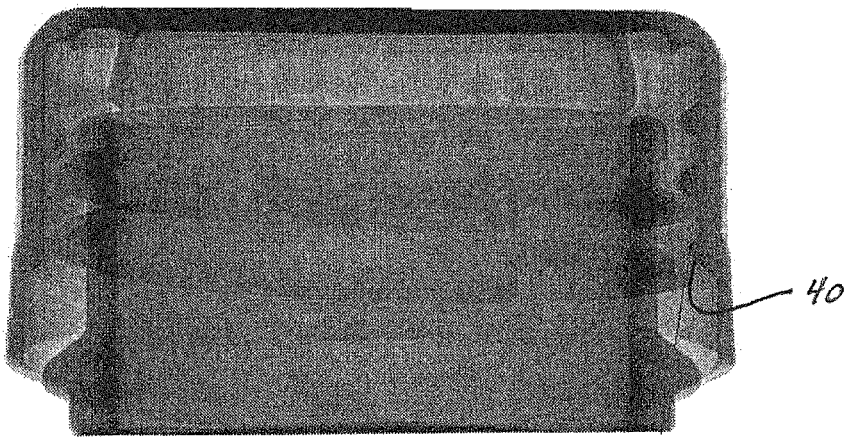
FIG. 4 is an x-ray image of a tamper-evident package embodying the principles of the present invention, including a tamper-evident closure embodying the principles of the present invention.
Figure 5:
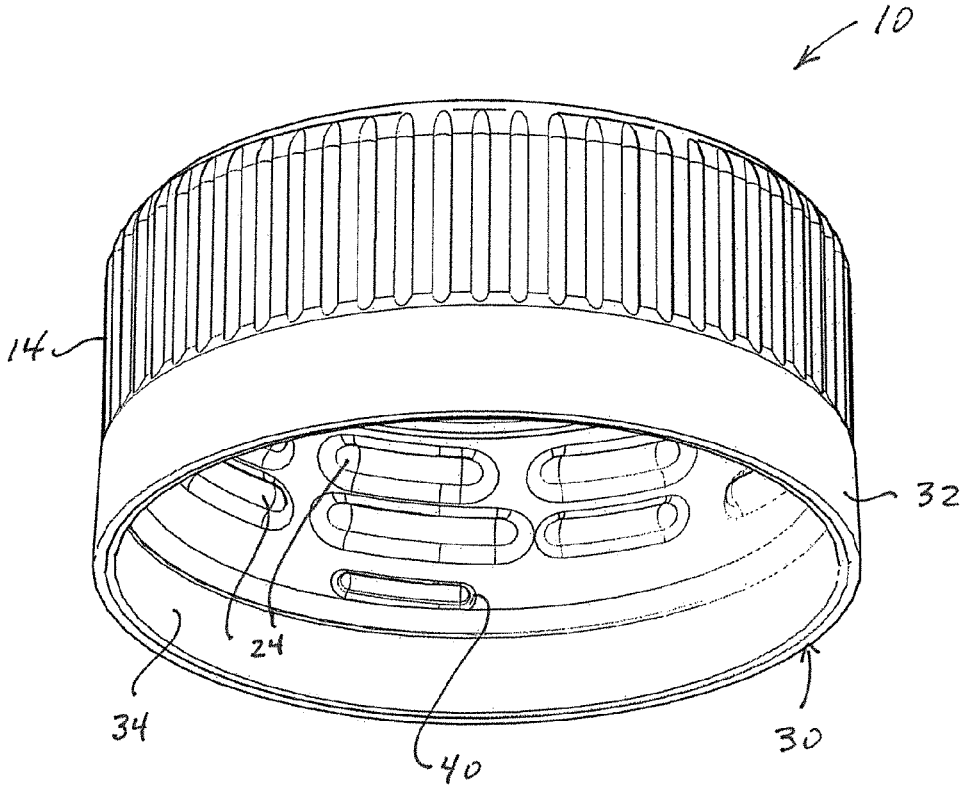
FIG. 5 is a diagrammatic, isometric view of a closure embodying the principles of the present invention.

Engagement of the application guide element 40 with the lower surface of external thread formation 22 of the container 20 is diagramatically illustrated in FIG. 3. Reference is also made to the X-ray image of FIG. 4, wherein the application guide element 40 is shown as the closure illustrated therein as applied to an associated container. In this X-ray image, the external threads of the container can be seen, as can the internal threads of the associated closure. It will be noted that the plug seal element of the closure has not yet entered the associated container, indicating that the closure is only partially applied to the container in this X-ray image.

Thus, as the closure 10 is rotatably applied to the container 20, the guide element 40 engages one of the external thread formations 22 of the neck portion of the container generally concurrently with engagement of one of the internal thread formation on the closure skirt portion with one of the container external thread formation. This desirably acts to maintain the closure in coaxial relationship with the container for proper fitment of the closure.

During closure application, it is contemplated that the guide element 40 will engage the external container thread to a sufficient degree to prevent cocking or misalignment of the closure 10 until the internal thread formation 22 of the closure is sufficiently engaged with the container thread to maintain the closure in coaxial alignment with the container. Thereafter, the size of the guide element, preferably having a profile less than that of the thread formation, prevents the guide element from interfering with continued threaded application of the closure to the container. While the guide element is preferably helically configured, it is not intended that the guide element affect the normal threaded engagement of the closure with the container. Rather, the guide element is intended to engage and "hook" the container thread to a sufficient to degree to permit the desired threaded engagement of the closure threads with the container threads.

Notably, during closure removal, a similar alignment function is desirably provided by the application guide element. During closure removal, just prior to disengagement of the closure internal thread formation from the container external thread formation, a closure without the guide element can cock or tilt, which can undesirably result in the closure becoming detached from the container prior to venting of gas pressure, such as from a package containing carbonated contents. The provision of the guide element opposite the thread start desirably acts to maintain the alignment of the closure with the container during removal, thus maintaining the closure in engagement with the container for a period which is sufficient to permit the venting of gas pressure from within the package.

Thus, it will be appreciated that the application guide element of the present invention desirably acts to "balance" engagement of the closure with the associated container attendant to high-speed application. Inclusion of the application guide element desirably results in proper alignment of the closure with the container being effected relatively earlier during closure application. In current products, as much as 180° of thread engagement of the closure thread with the container thread is ordinarily required before the tendency to tilt, cock, or misalign is minimized. It is this characteristic that undesirably increases the chances of application defects for standard closures including separate sealing liners. The issues concerning this application become even more significant on linerless closures, especially those having so-called extended plugs seals, where cocking or misalignment of the closure can undesirably lead to improper engagement of the plug with the interior of the neck portion of the container. This can undesirably result in the plug partially seating outside of the bottle instead of fully inside, and in general, will cause sealing issues.

The optimal placement of the application guide element of the present invention can result in minimizing the tilting of the closure within 45° of the main closure thread engagement with the container thread. This has a very desirable impact of the robustness of the closure with respect to any equipment alignment issues in connection with high-speed closure application.

From the foregoing, it will be observed that numerous modification and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A closure for a container, comprising:

a top wall portion, and an annular skirt portion depending from said top wall portion, said skirt portion including one or more internal thread formations for respective engagement with one or more external thread formations of said container, each of said internal thread formations being defined by a respective helix, and each having a thread start opposite said top wall portion, said skirt portion further including at least one application guide element positioned on the inside surface of said skirt portion, said application guide element being vertically offset from each said helix, and being circumferentially displaced from each said thread start, said guide element being engageable with one of said one or more external thread formations of the neck portion of said container to facilitate threaded application of said closure to said container, said skirt portion of said closure defining a pair of internal thread formations, said skirt portion including plural ones of said application guide elements, wherein each said application guide element is centered at a point circumferentially spaced about 90 degrees from the thread start of a respective one of said plural internal thread formations.

2. A closure for a container in accordance with claim 1, wherein each said application guide element extends less than 180 degrees about the circumference of said closure.

3. A closure for a container in accordance with claim 1, wherein each said application guide element has a profile less than the profile of said one or more internal thread formations.

4. A closure for a container in accordance with claim 1, including a tamper-evident band including an annular band portion detachably connected to said skirt portion, and a interference flange extending inwardly of and continuously about the circumference of said band portion.

5. A closure for a container in accordance with claim 1, including a plug seal element extending downwardly from an inside surface of said top wall portion, said plug seal element being configured for sealing engagement with an inside surface of a neck portion of said container.

6. A closure for a container in accordance with claim 1, wherein each said application guide element has a helical configuration corresponding in orientation and pitch to said one or more internal thread formations.

7. A tamper-evident package, comprising:

a container having a neck portion defining one or more external thread formations; and a plastic closure for application to said container for closing the contents of the container, said closure including a top wall portion, an annular skirt portion depending from said top wall portion, and a tamper-evident pilfer band at least partially detachably connected to, and depending from, said skirt portion, said skirt portion including one or more internal thread formations for respective engagement with said one or more external thread formations of said container, each of said internal thread formations being defined by a respective helix, and each having a thread start opposite said top wall portion, said skirt portion further including at least one application guide element positioned on the inside surface of said skirt portion, said application guide element being separate from said thread internal thread formations and circumferentially displaced from each said thread start, said guide element being engageable with one of said one or more external thread formations of the neck portion of said container to facilitate threaded application of said closure to said container, said neck portion of said container defines a pair of external thread formations, and said skirt portion of said closure defines a pair of internal thread formations, said skirt portion including plural ones of said application guide elements, wherein each said application guide element is centered at a point circumferentially spaced about 90 degrees from the thread start of a respective one of said pair of internal thread formations.

8. A tamper-evident package in accordance with claim 7, wherein each said application guide element has a radial dimension less than radial dimension of said one or more internal thread formations.

9. A tamper-evident package in accordance with claim 7, wherein each said application guide element has a helical configuration.

10. A tamper-evident package, comprising:

a container having a neck portion defining one or more external thread formations; and a plastic closure for application to said container for closing the contents of the container, said closure including a top wall portion, an annular skirt portion depending from said top wall portion, and a tamper-evident pilfer band at least partially detachably connected to, and depending from, said skirt portion, said skirt portion including one or more internal thread formations for respective engagement with said one or more external thread formations of said container, each of said internal thread formations being defined by a respective helix, and each having a thread start opposite said top wall portion, said skirt portion further including at least one application guide element positioned on the inside surface of said skirt portion, said application guide element being separate from said thread internal thread formations and circumferentially displaced from each said thread start, said guide element being engageable with one of said one or more external thread formations of the neck portion of said container to facilitate threaded application of said closure to said container, wherein said neck portion of said container defines plural ones of said external thread formations, and said skirt portion of said closure defines plural ones of said internal thread formations, said skirt portion including plural ones of said application guide elements, wherein each said application guide element is circumferentially spaced about C degrees from the thread start of a respective one of said plural internal thread formations, where C equals 180/N, where N equals the number of said internal thread formations.

* * * * *